US007749428B2

(12) United States Patent
Sugawara et al.

(10) Patent No.: US 7,749,428 B2
(45) Date of Patent: Jul. 6, 2010

(54) METHOD OF MANUFACTURING A CLAD MATERIAL OF BRONZE ALLOY AND STEEL

(75) Inventors: Hiroyuki Sugawara, Inuyama (JP); Yasuo Ido, Inuyama (JP); Yoshiaki Sato, Inuyama (JP); Yukio Ogita, Inuyama (JP); Shigemasa Hakakoshi, Inuyama (JP)

(73) Assignee: Daido Metal Co Ltd., Nagoya (JP)

( * ) Notice: Subject to any disclaimer, the term of this patent is extended or adjusted under 35 U.S.C. 154(b) by 495 days.

(21) Appl. No.: 11/727,440

(22) Filed: Mar. 27, 2007

(65) Prior Publication Data

US 2007/0224074 A1 Sep. 27, 2007

(30) Foreign Application Priority Data

Mar. 27, 2006 (JP) ..... 2006-086477

(51) Int. Cl.
*B22F 7/04* (2006.01)

(52) U.S. Cl. ..... 419/8; 419/2; 419/26; 419/28; 428/547; 428/615

(58) Field of Classification Search ..... 419/8
See application file for complete search history.

(56) References Cited

U.S. PATENT DOCUMENTS 5,964,115 A * 10/1999 Hansen ..... 72/229
6,766,817 B2 7/2004 da Silva
6,918,404 B2 7/2005 da Silva
7,066,586 B2 6/2006 da Silva
2003/0173000 A1 9/2003 Sakai et al.
2004/0069381 A1 * 4/2004 Pawelski ..... 148/648
2005/0288195 A1 * 12/2005 Heenan et al. ..... 508/430

FOREIGN PATENT DOCUMENTS

JP 6-337026 12/1994
JP 2003-269456 9/2003

* cited by examiner

*Primary Examiner*—Roy King
*Assistant Examiner*—Christopher Kessler
(74) *Attorney, Agent, or Firm*—Browdy and Neimark, PLLC

(57) ABSTRACT

A manufacturing method of a clad material composed of a bronze alloy and a steel is provided, including: scattering a bronze alloy powder on a steel back metal; sintering the bronze alloy powder to obtain a bilayer material having a porous bronze alloy layer on the steel; dry-rolling and a sintering the bilayer material so that the bronze alloy layer has a porosity of 3% or less; and wet-rolling the bilayer material with supplying a rolling oil to surfaces of rolling rolls. The clad manufactured according to this method can be heat-treated without an disadvantage in a conventional wet-rolling that entering rolling oil vaporizes in the bronze alloy layer during the heat treatment to form new voids. Therefore, it becomes possible to make a bronze alloy layer high in density in small times of rolling, thus enabling an increase in production efficiency.

7 Claims, 1 Drawing Sheet

METHOD OF MANUFACTURING A CLAD MATERIAL OF BRONZE ALLOY AND STEEL

TECHNICAL FIELD

The present invention relates to a method of manufacturing a clad material by sintering.

BACKGROUND OF THE INVENTION

Conventionally, it has been known to use a clad material composed of a bronze alloy, such as high tin bronze or phosphor bronze, having a high impact strength and a low-carbon steel having a high ductility, as a member used for a clutch of an automatic transmission for automobiles, such as an end plate of one-way clutch (see paragraph [0011] of JP-A-6-337026). The clad material is manufactured by scattering a bronze powder on a steel plate and repeating sintering and dry-rolling, in which processes a sintering temperature and rolling reduction are selected paying attention to grain growth of the steel plate at the sintering temperature and to densification of the bronze alloy, as stated in paragraph [0018] of JP-A-2003-269456. When the grains of the steel become gross or when the bronze alloy layer has a high porosity, working stress will be concentrated on grain boundaries of the steel or pores of the bronze alloy layer, which may become starting points of cracks at the time of working such as deep drawing or the like. Dry-rolling is adopted for the manufacturing process, because there is caused a problem, when wet-rolling is adopted in which a rolling oil is supplied to surfaces of rolling rolls, that the rolling oil enters through capillary phenomenon into pores deep in a sintered bronze alloy layer and in a subsequent step the entering oil vaporizes in the sintered layer during heat treatment for sintering to form further voids.

For the clad material composed of the bronze alloy having a high impact strength and a low-carbon steel having a high ductility, hardness of the bronze alloy becomes greater than that of the low-carbon steel in rolling. Thus, a ratio of reduction of the low-carbon steel in respect to total reduction of the clad material is increased, and so the bronze alloy is hard to be reduced in a case where a bronze alloy having a high strength is used, or a steel having a low strength is used. When a ratio of reduction is increased in excess in the dry-rolling, it will cause a problem that seizure is generated between surfaces of rolling rolls and surfaces of the clad material. Therefore, in order to adequately attain densification of the bronze alloy in the clad material, dry-rolling is performed in several stages so that dry-rolling and sintering are repeated, which has a disadvantage of bad production efficiency.

SUMMARY OF THE INVENTION

The invention has been thought of in view of the situation described above, and its object is to provide a method of manufacturing a clad material of a bronze alloy and a steel, which enables densification of the bronze alloy without decreasing production efficiency.

In order to attain the object, the invention provides a method comprising:

scattering a bronze alloy powder on a steel back metal;

sintering the bronze alloy powder to obtain a bilayer material having a porous bronze alloy layer on the steel;

dry-rolling and sintering the bilayer material so that the bronze alloy layer has a porosity of 3% or less; and wet-rolling the bilayer material with supplying a rolling oil to surfaces of rolling rolls.

According to the invention, a bilayer material composed of a bronze alloy having a porosity of 3% or less and a steel is wet-rolled, whereby heat treatment in a subsequent step can be performed without an disadvantage involved in a conventional wet-rolling, in which a rolling oil enters into pores deep in a sintered layer through capillary phenomenon, and the entering rolling oil vaporizes in the sintered layer during heat treatment (sintering) in a subsequent step to form new voids. Therefore, it becomes possible to make a bronze alloy layer high in density in small times of rolling, thus enabling to increase production efficiency.

In addition, when a bilayer material, a bronze alloy layer of which has porosity of greater than 3% by dry-rolling, is wet-rolled, the process has the disadvantage described above, so that the porosity of the bronze alloy layer is limited to 3% or less. In order to attain a porosity of 3% or less for the bronze alloy layer, the dry-rolling may be normally performed one time, but the rolling may be performed in several stages in consideration of the composition of the bronze alloy or a final thickness accuracy of the clad material, etc., or the alloy may be sintered and annealed between the stages of the dry-rolling.

Preferably, the bronze alloy is a Cu—Sn based alloy or a Cu—Sn—P based alloy. Thereby, it is possible to manufacture a clad material having a high impact strength.

Preferably, the steel back metal is a low-carbon steel. Thereby, it is possible to manufacture a clad material which facilitates drawing.

Preferably, the rolling oil used in the wet-rolling is a paraffinic lubricating oil. Thereby, a change in viscosity with temperature is small and wet-rolling is facilitated.

DETAIL DESCRIPTION OF THE INVENTION

An embodiment of the invention will be described below.

Figure 1A:
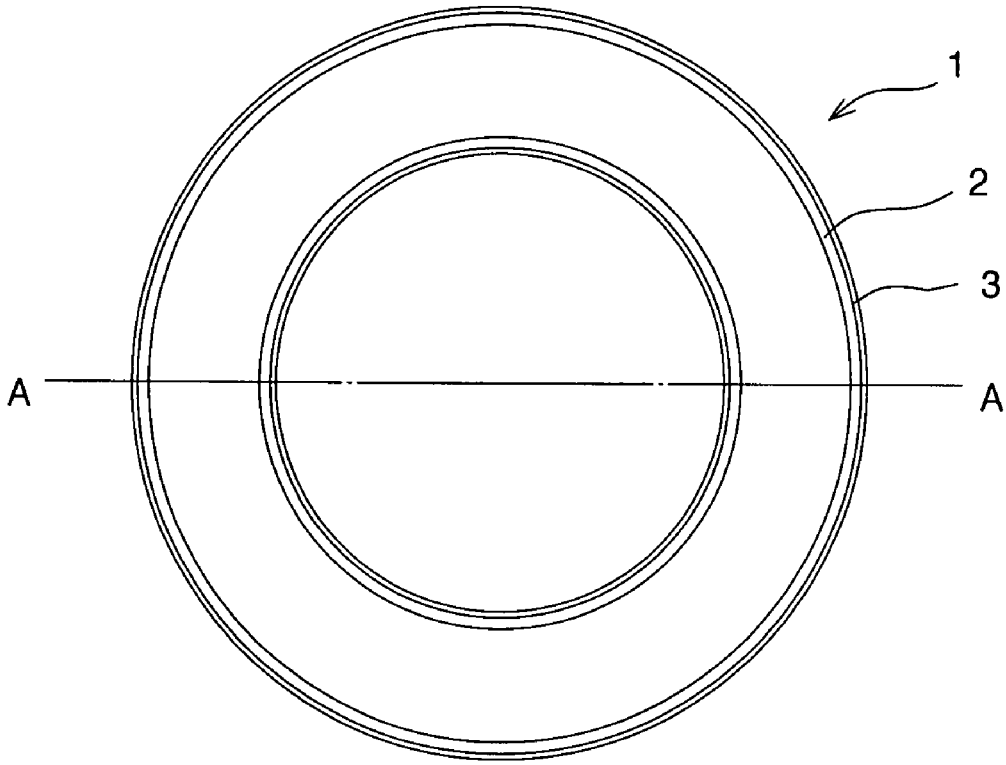
FIG. 1A is a front view showing an end plate made of a clad material manufactured by a method according to the invention, used for a clutch of an automatic transmission for automobiles.
Figure 1B:
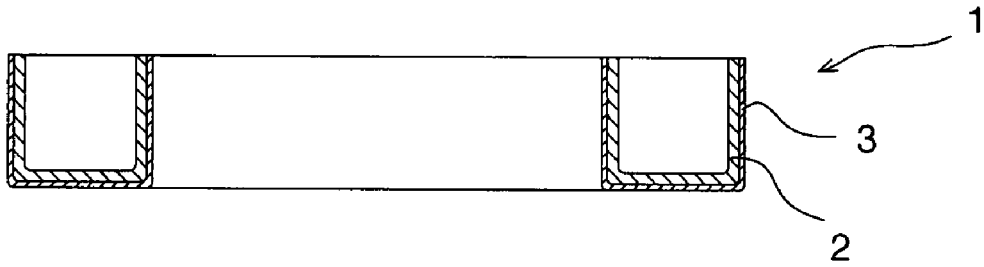
FIG. 1B is a cross sectional view taken along the line A-A in FIG. 1A.

FIG. 1A is a front view showing an end plate 1 in case where a clad material manufactured by the method according to the invention is applied to an end plate used for a clutch of an automatic transmission for automobiles, and FIG. 1B is a cross sectional view taken along the line A-A. The end plate 1 is used to maintain a spacing between an inner ring and an outer ring in a one-way clutch for automatic transmissions, etc., and is formed as an annular member having a C-shaped cross section. The end plate 1 is made of a clad material laminating a bronze alloy layer 3 (a Cu—Sn based alloy or a Cu—Sn—P based alloy) on a surface of a low-carbon steel 2 (for example, SPCC being a cold-rolled steel for automobiles, SPCD being a steel for drawing, or SPCE being a steel for deep drawing), and manufactured by drawing the clad material with the steel side thereof defining an inner surface.

The clad material is manufactured by a method according to the invention. A bronze alloy powder is scattered on a steel back metal. The steel back metal scattered with the bronze powder is heated, for example at about 800 to about 950° C., in a reducing furnace to sinter the bronze powder. In this manner, a bilayer material having a porous bronze alloy layer on the steel is obtained. Porosity of the bronze alloy layer is more than 3% at this stage. Then, the bilayer material is dry-rolled and sintered so that the bronze alloy layer has a porosity of 3% or less. A ratio of reduction in the dry-rolling and the sintering temperature can be arbitrary selected as to make the porosity of the bronze alloy layer be 3% or less. For example, the ratio of reduction can be about 10 to about 60%, and the sintering temperature can be about 800 to about 950° C. The bilayer material is then wet-rolled while a rolling oil is supplied to surfaces of rolling rolls.

According to the invention, heat treatment in a subsequent step can be performed without an disadvantage involved in a conventional wet-rolling, in which the capillary phenomenon causes a rolling oil to enter into pores deep in a sintered layer and the entering rolling oil vaporizes in the sintered layer during heat treatment (sintering) in a subsequent step to form new voids. Therefore, it becomes possible to make a bronze alloy layer high in density in small times of rolling, thus enabling an increase in production efficiency.

Hereupon, performances of clad materials manufactured by the method of the invention and by conventional methods will be described with reference to TABLE 1. Sample products in TABLE 1 were manufactured in the following manner.

First, Sample in the invention was prepared as follows.

After a bronze alloy powder (−60 mesh) of Cu-6 mass % Sn-0.1 mass % P was scattered on a low-carbon steel (SPCE) having a thickness of 1.5 mm, the steel with the bronze alloy powder thereon was sintered at 950° C. in a reducing sintering furnace for 15 minutes. After cooled it was dry-rolled with rolling rolls and then sintered again under the same condition to provide a bilayer material composed of a bronze alloy layer having a porosity of 3% and a thickness of 0.35 mm and a low-carbon steel having a thickness of 1.35 mm. Thereafter, the bilayer material was wet-rolled with rolling rolls while a rolling oil (mineral oil purified from a paraffinic stock oil) was being supplied to surfaces of the rolls. In rolling, a ratio of reduction was determined to be a critical one (shown in TABLE 1), in which any microscopic seizure was not generated between surfaces of the rolls and surfaces of the bilayer material. Thereafter, in order to facilitate drawing, the clad material was annealed at 810° C. in a reducing sintering furnace for 15 minutes. Thus, the Sample in the invention was provided.

Next, Comparative example 1 was prepared as follows.

Processes for obtaining a bilayer material having a bronze alloy layer having a porosity of 3% were the same as those for preparing the Sample in the invention. In this example, however, the bilayer material was then dry-rolled. In rolling, a ratio of reduction was determined to a critical one (shown in TABLE 1), in which any microscopic seizure was not generated between surfaces of the rolls and surfaces of the bilayer material. Thereafter, in order to facilitate drawing, the clad material was annealed at 810° C. in a reducing sintering furnace for 15 minutes. Thus, Comparative example 1 was provided.

Comparative example 2 was prepared as follows.

Processes for obtaining a bilayer material having a bronze alloy layer having a porosity of 3% were the same as those in preparing the Sample in the invention. In this example, however, the bilayer material was then dry-rolled two times. In rolling, a ratio of reduction was determined to a critical one (shown in TABLE 1), in which any microscopic seizure was not generated between surfaces of the rolls and surfaces of the bilayer material. In an interval between the two dry-rollings, anneal was performed at 810° C. in a reducing sintering furnace for 15 minutes. Thereafter, in order to facilitate drawing, the clad material was annealed at 810° C. in a reducing sintering furnace for 15 minutes. Thus, Comparative example 2 was provided.

Comparative example 3 was prepared as follows.

Processes for obtaining a bilayer material were the same as those in preparing the Sample in the invention, while a bronze alloy layer has a porosity of 4%. In this example, however, the bilayer material was then wet-rolled with rolling rolls while a rolling oil (mineral oil purified from a paraffinic stock oil) was supplied to surfaces of the rolling rolls in the same manner as in the Sample in the invention. In rolling, a ratio of reduction was determined to a critical one (shown in TABLE 1), in which any microscopic seizure was not generated between surfaces of the rolls and surfaces of the bilayer material. Thereafter, in order to facilitate drawing, the clad material was annealed at 810° C. in a reducing sintering furnace for 15 minutes. Thus, Comparative example 3 was provided.

TABLE 1

| | POROSITY OF BRONZE ALLOY BEFORE ROLLING | CRITICAL REDUCTION (%) AT FIRST TIME | CRITICAL REDUCTION (%) AT SECOND TIME | POROSITY OF BRONZE ALLOY AFTER ROLLING | PRESENCE OR ABSENCE OF CRACK IN BRONZE ALLOY |
|---|---|---|---|---|---|
| SAMPLE IN THE INVENTION | 3.0 | 38 | — | 0.3 | ABSENCE |
| COMPARATIVE EXAMPLE 1 | 3.0 | 15 | — | 1.9 | PRESENCE |
| COMPARATIVE EXAMPLE 2 | 3.0 | 15 | 15 | 1.0 | ABSENCE |
| COMPARATIVE EXAMPLE 3 | 4.0 | 38 | — | 2.0 | PRESENCE |

In TABLE 1, the "porosity of bronze alloy before rolling" indicates a porosity of the bronze alloy layer at a stage when a bilayer material was obtained by dry-rolling, and the "porosity of bronze alloy after rolling" indicates a porosity of the bronze alloy layer after rolled with critical ratio of reduction at first time or at second time in TABLE 1. The "presence or absence of crack in bronze alloy" indicates presence or absence of a crack in a bronze alloy layer of a C-shaped rounded bent portion when the clad material is drawn to an end plate (outside diameter of 90 mm and inside diameter of 78 mm) as shown in FIG. 1.

In the Sample in the invention, the critical ratio of reduction is high, and porosity of the bronze alloy after rolling is low. Furthermore, no cracks are generated in the bronze alloy layer, and it is possible to provide a clad material having a high impact strength.

On the other hand, the Comparative example 1 has a low in impact strength because a critical ratio of reduction is low and the bronze alloy after rolling has high porosity, and because cracks are generated in the bronze alloy layer.

Comparative example 2 is low in porosity of the bronze alloy after rolling as compared with Comparative example 1 since it is twice dry-rolled with a critical ratio of reduction and is sintered in an interval between two dry-rollings. There are no cracks in the alloy layer. However, since this process needs two steps of dry-rolling and a step of annealing between the rolling steps, productivity is largely decreased. Furthermore, while wet-rolling was applied in Comparative example 3 under the same condition as that in Comparative example 1, a rolling oil having entered into pores vaporized in a sintering step because the bronze alloy layer before rolling has high porosity. Thus, the porosity of the alloy after rolling is also high and cracks are generated in an alloy layer because new voids are formed. Therefore, a clad material thus obtained becomes low in impact strength.

TABLE 2 indicates critical rolling speeds of the Sample in the invention and Comparative example 1 for comparison between them. The critical rolling speed is such that any microscopic seizure is not generated between surfaces of rolls and surfaces of a bilayer material at that speed. As apparent from TABLE 2, it can be understood that the Sample in the invention is excellent in production efficiency since it has a large critical rolling speed although it is high in rolling reduction as compared with Comparative example 1.

TABLE 2

| | CRITICAL ROLLING SPEED (m/min) |
|---|---|
| SAMPLE IN THE INVENTION | 19.5 |
| COMPARATIVE EXAMPLE 1 | 11.2 |

In annealing required for facilitating drawing after wet-rolling, the clad material may be heated in either of a plate threading type continuous furnace or a batch furnace in a wound coil.

The invention claimed is:

1. A method of manufacturing a clad material composed of a bronze alloy and a steel, the method comprising:

scattering a bronze alloy powder on a steel back metal;

sintering the bronze alloy powder to obtain a bilayer material having a porous bronze alloy layer on the steel;

dry-rolling and a sintering the bilayer material to form a porous bronze alloy layer having a porosity of 3% or less; and wet-rolling the bilayer material with supplying a rolling oil to surfaces of rolling rolls.

2. The method according to claim 1, wherein the bronze alloy is a Cu—Sn based alloy or a Cu—Sn—P based alloy.

3. The method according to claim 1, wherein the steel back metal is made of a low-carbon steel.

4. The method according to claim 1, wherein a paraffinic lubricating oil is used as the rolling oil in the wet-rolling.

5. The method according to claim 2, wherein the steel back metal is made of a low-carbon steel.

6. The method according to claim 2, wherein a paraffinic lubricating oil is used as the rolling oil in the wet-rolling.

7. The method according to claim 3, wherein a paraffinic lubricating oil is used as the rolling oil in the wet-rolling.

* * * * *